United States Patent [19]

Dessauer

[11] Patent Number: 4,549,930

[45] Date of Patent: Oct. 29, 1985

[54] UNCOATED PAPER WEB FOR PRINTING AND METHOD FOR MAKING AND USING SAME

[75] Inventor: Guido Dessauer, Düsseldorf, Fed. Rep. of Germany

[73] Assignee: Feldmühle Aktiengesellschaft, Düsseldorf, Fed. Rep. of Germany

[21] Appl. No.: 136,557

[22] Filed: Apr. 2, 1980

[30] Foreign Application Priority Data

Apr. 6, 1979 [DE] Fed. Rep. of Germany ..... 2913941

[51] Int. Cl.[4] ..... D21F 11/00

[52] U.S. Cl. ..... 162/134; 162/181.8

[58] Field of Search ..... 162/181 R, 181 D, 134, 162/206, 181.8

[56] References Cited

U.S. PATENT DOCUMENTS 1,847,326 3/1932 Alsted ..... 162/181 D
3,433,704 3/1969 Hecklan et al. ..... 162/181.8

FOREIGN PATENT DOCUMENTS 1093041 11/1967 United Kingdom .
1522287 8/1978 United Kingdom .
1533401 11/1978 United Kingdom .

OTHER PUBLICATIONS

Casey, *Pulp and Paper,* vol. III, (1961) pp. 1809, 1810.

*Primary Examiner*—Peter Chin
*Attorney, Agent, or Firm*—Toren, McGeady, Stanger, Goldberg & Kiel

[57] ABSTRACT

An uncoated paper web suitable for rotogravure printing with water-immiscible solvent-containing inks, the fibers of the web being partially or totally enveloped with a clay hydrogel, the clay being hydratable, colloidal and film-forming. The web provides superior printing results in rotogravure printing. A method for printing the web is disclosed.

8 Claims, No Drawings

UNCOATED PAPER WEB FOR PRINTING AND METHOD FOR MAKING AND USING SAME

BACKGROUND OF THE INVENTION

1. Field of the Invention

The present invention relates to the rotogravure printing of an uncoated paper web with printing inks which contain water-immiscible solvents.

2. Description of the Prior Art

Uncoated, highly supercalendered and highly filled papers are produced on a large scale and are used as the print carrier in magazine and illustration rotogravure. These papers are referred to hereinafter as natural rotogravure papers. They are printed with printing inks, which contain a considerable proportion of water-immiscible solvents. Such solvents are, for example, toluene, xylene and benzene.

Constantly increasing quality of the natural rotogravure paper is being demanded because of changes in the paper making and rotogravure processes. Specifically, this is due to the increasing speed of the paper machines and the consequently accelerated dewatering on the Fourdrinier, since with twin wires, a less homogeneous paper sheet would be produced as well as the increasing speeds of the rotogravure printing machines.

One of the major problems resulting from the higher machine speeds is that a lower printing ink viscosity is required which, in turn, affects the "migration" of the printing ink into the paper.

The migratory properties of a printing ink are regarded as good if the ink, in the brief period between application and drying, does not migrate away from the point of application so that the contours of the ink on the printed and dried paper are the same as they were when the ink was applied to the paper, i.e., the image is sharp. In the case of poor migration properties, the printing ink penetrates into the paper and spreads out, which leads to a nonuniform and blurred printing image. In black areas, for example, insufficient blackening occurs and the printed image has inferior gloss. At the same time, the uneven distribution of fibers and filler material in the microregion of the surface can be observed in the printed image.

Various attempts have been made to improve the printability of papers. German Pat. No. 828,478 proposes that various minerals, such as, zeolite, be added to the fibrous material or that these minerals, in combination with starch or different binders be applied to the surface of the paper in a preparation step. At the same time, the penetration of oily molecules or of other printing fluids is promoted by the channels which traverse the interior of these minerals.

German Pat. No. 844,402 discloses the addition and distribution of discrete clay particles as a filler in the structure of the paper to prevent a running of the printing ink because of their adsorption effect. The use of oil-absorbing substances for improving the printing properties is also described in British Pat. No. 1,093,041. These substances are synthetically produced pigments having an amorphous structure and are used as fillers in a conventional manner.

The use of extruded minerals, such as, kaolin or attapulgite has been suggested in U.S. Pat. No. 3,433,704 for the production of newsprint. The oils used in newsprint ink tend to migrate through the paper and give rise to the formation of translucent areas in the printed paper. The use of the extruded minerals is intended to prevent the printed image which is applied to one side of the paper from showing through on the side by limiting the reduction in opacity caused by the oils.

These proposals are based on utilizing the adsorption properties of the different minerals for printing inks or on increasing the printing opacity. This approach, which is also adhered to in the reference "Physical Chemistry of Pigments in Paper Coating", page 422, has not been practiced in rotogravure printing with solvent-containing printing inks, i.e, printing inks containing toluene. This may primarily be attributed to the fact that the construction of rotogravure inks is completely different from that of newsprint inks. The latter having a significantly higher viscosity of about 50 Pascal seconds, while rotogravure inks have an average viscosity of 10 and a maximum viscosity of 20 Pascal seconds. In actual practice, however, viscosities of 4 Pascal seconds are also used in rotogravure printing. The already mentioned oils, predominantly mineral oils, are used as color carriers in printing newsprint, while more volatile solvents, especially toluene and benzene, in which natural or synthetic resins are dissolved, are used in rotogravure printing. The color carriers of newsprint inks remain in the paper while the toluene used as a solvent for the resins, evaporates immediately.

However, newsprint paper also has a generally different construction than the natural rotogravure papers addressed in the present application. Specifically, natural rotogravure papers have the maximum possible amount of fillers added. Additionally, they have a higher chemical pulp content and differ in their physical properties, e.g., they have a much higher density and higher smoothness which is obtained by a supercalandering process.

Newsprint paper, on the other hand, is only machine-calandered, is run with the addition of only insignificant amounts of filler and has a density of about 0.6 g/cc.

The enveloping of fibrous materials with hydratable colloidal, film-forming clays is disclosed in German Pat. Nos. 2,451,216 and 2,608,239. German Pat. No. 2,451,216 deals with a acceptor paper, in which hydratable, colloidal clays or fibrous materials coated with such clays are contained as color acceptors for suitable color precursors. On the other hand, German Pat. No. 2,608,239 describes an image receiving material for electrophotographic processes, in which hydratable, film-forming, colloidal clays become effective to fix the water-extractable harmful substances of the type released by the thermofixation of toner particles.

These patents disclose the use of such enveloped fibers which have a high adsorptive power for that particular function.

SUMMARY OF THE INVENTION

We have discovered an uncoated paper for rotogravure printing which possesses significantly superior migration properties as compared to conventional natural gravure papers. The paper of the present invention can be printed very satisfactorily with inks which contain water-immiscible solvents.

More particularly, the paper of the present invention is composed of a fibrous web, the fibers of which are partially or totally enveloped with a clay hydrogel which clay is hydratable, is colloidal, and is film-forming, said web having an area weight of from about 45 to 100 g/m$^2$, a density of from about 0.95 to 1.2 g/cc and a smoothness of from about 600 to 1500 Bekk seconds.

It is particularly surprising that the high adsorptive power of these materials has no effect relative to the printing inks as it would have to be expected in accordance with the above-mentioned prior art, but that, rather, a repelling effect occurs relative to the printing ink.

DESCRIPTION OF THE PREFERRED EMBODIMENTS

The outstanding effect obtained with the present invention, in comparison to conventional natural gravure papers, which contain no hydratable, film-forming colloidal clays enveloping the fibers, is probably attributable to the fact that the extensive homogenization of the paper surface is achieved by the envelopment of the fibers. As a result, the printing ink comes into contact with a surface which consists of a uniform material, because the different fibrous materials used have the same surface due to their film-like envelope. The conventional fillers, which are added to the fibrous material as a pigment during the manufacturing process cannot envelop the fiber itself but are merely filtered off during the sheet formation on the Fourdrinier and cannot produce this homogeneity. Rather, demixing takes place to a varying extent during the dewatering of the paper sheet, whereby the fillers accumulate on the upper side of the paper sheet.

The essential reason for the decreased migration may well be the fact that the hydratable, film-forming, colloidal clays contain a considerable amount of bound water which is not the case with conventional fillers. This higher water content is attributable to the property of film-forming, hydratable, colloidal clays of swelling in water and thereby retaining large quantities of water in the films which are formed.

At the drying temperatures, conventionally used in a paper machine, this water cannot evaporate and, because it is not miscible with the solvent of the gravure ink, it exerts a repelling effect in the printing ink.

This is a short-term effect, which is however completely adequate because, at the high machine speeds of the printing machine in the drying section, only fractions of a second elapse between the application of the printed image and the evaporation of the highly volatile solvent.

The use of additional and conventional inorganic fillers, which are added in the usual manner to the pulp before sheet formation, produces sufficient opacity and whiteness in the paper sheet. In the case of a combined batch, of, for example, kaolin, as additional inorganic filler together with hydratable, colloidal, film-forming clays, in a common mixing vat and subsequent mixing with the fibrous paper material, not only the fibers are enveloped which can easily be detected by suitable staining methods but also a partial film-like enveloping of the kaolin particles takes place. Consequently, there is an even better homogenization, because the printing ink is then printed on fiber and filler material which is coated with the same material to the greatest extent possible.

In the production of paper, the drying process of the paper web is followed by a supercalendering treatment in which the paper web is compressed to a density of about 0.95 to 1.2 g/cc. In doing, so the Bekk gloss is advantageously adjusted to about 600 to 1,500 seconds. By the use of natural rotogravure papers, whose fibers are enveloped at least partially in the inventive manner with clays, substantial improvements in the printing results are obtained from the point of view of migration. The range of area weight preferably is between about 45 and 100 g/m$^2$. Excellent improvements over the previously known natural rotogravure papers are obtained with an area weight of from about 55 to 70 g/m$^2$.

Especially advantageous results are obtained from the use of such papers in which the amount of fiber-enveloping, film-forming, colloidal clays are about 1.2 to 8 weight percent of the total material. If lesser amounts are added, the decrease in migration is insufficient while, if higher amounts are added, the dewatering speed of the paper web is adversely affected because of the particularly high water absorptive capacity or water retention capacity of the special types of clay.

Particularly suitable papers in accordance with the present invention for use in rotogravure processes are those whose fibrous material is enveloped with montmorillonite clays selected from the group of bentonites, with an attapulgite or a sepiolite. Not sufficiently swelling clay materials from these groups have, however, proven to be unsuitable because they do not have the ability to envelop the fibers in the manner of a gel or a film. Thus, the film-forming property is important to achieve the desired results. Such clay minerals, when added to the pulp, do not possess a significant amount of bound water after the paper web is dried and, in their mode of action, merely correspond to the conventional pigment fillers.

A particular advantage resides in the use of natural rotogravure papers whose fibers are enveloped by a naturally occuring bentonite clay whose montmorillonite mineral has a ratio of sodium and calcium ions of between 40:60 to 60:40. The strength and elasticity of the film enveloping the fibers is in this case significantly improved over a clay which contains as the mineral a 100% sodium montmorillonite. If a clay with this ion ratio is not available, a natural rotogravure paper whose fibers are enveloped by a colloidal, film-forming clay in which an ion exchange in the above-mentioned ratio has taken place by a treatment with soda or soda lye can be advantageously used. The initial product for such a clay may be a 100% calcium bentonite.

An especially advantageous embodiment of the invention can be obtained through the use of a natural rotogravure paper, the fibers of which are enveloped by a colloidal, film-forming clay whose montmorillonite mineral contains up to 40% magnesium ions and whose residual ion portion consists of sodium ions.

Clay of this type is obtained from a 100% calcium bentonite by initially converting it to a 100% sodium bentonite using a soda lye or soda treatment and, subsequently, exchanging a portion of the sodium ions for magnesium ions by adding a magnesium salt, for example, magnesium sulfate, or magnesium hydroxide. Excellent results were obtained with an ion ratio of 25:75 magnesium to sodium ions.

A further improvement of the migratory property can be achieved by using a natural rotogravure paper in which organic water-soluble macromolecules are connected to the highly swellable and film-forming clays which envelope the fibers. In this connection, polyethylene oxides with a molecular weight of between 5,000 to 100,000 are preferred as the macromolecules. These substances, which are called polyglycols can be added to the clay suspension after the ion exchange has been performed in amounts of from about 10% by weight polyglycol from a solution having a maximum concentration of about 10%. The quality of the film is not impaired by this addition.

Another advantageous embodiment provides for the use of a natural rotogravure paper whose fibers are enveloped by highly swellable and film-forming clays and in which an aqueous solution of a polyglycol is sprayed onto the web of material prior to rolling up the paper.

When natural rotogravure papers with clay-enveloped fibers are used, the most significant improvement lies in achieving less migration. However, because the amounts of hydratable, film-forming, colloidal clays used are at most 8 weight percent, based on the total furnish, they do not have a detrimental effect on other important properties, such as, opacity, brightness, smoothness and gloss. In order to obtain these properties, the addition of conventional, inorganic fillers is therefore unavoidable and an ash content of greater than 15% by weight has proven to be advantageous. The amount to be added to the pulp suspension before the formation of the sheet may be up to about 20 weight percent higher than the amount which is actually to be retained in the paper. Thus, the difference between the amount added and the amount retained in the paper may be attributed to losses, which usually occur in the manufacture of paper, even when retention aids are used.

Suitable fillers for use include kaolin, calcium carbonate, talc, titanium dioxide, barium sulfate and calcium sulfate. Kaolin, calcium carbonate and talc have proven to be particularly suitable.

For economic reasons, efforts are made to keep the portion of the cost attributable to the fibrous material as small as possible. Newsprint is therefore frequently manufactured without the addition of any chemical woodpulp. In the case of natural rotogravure papers, which are higher grade material, the use of a certain amount of chemical woodpulp cannot be avoided. For the purposes of the present invention, a paper is particularly suitable for use in rotogravure printing if it contains more than about 10 weight percent of chemical woodpulp, based on the total amount of fibrous material.

A further improvement can be achieved by using paper, whose fiber portion consists of about 20 to 25 weight percent of chemical woodpulp and about 75 to 80 weight percent of mechanical woodpulp. Preferably, kaolin and hydratable, colloidal, film-forming clays are added to such a fibrous material in an amount so that, based on the total weight, there is about 18 to 26 weight percent of kaolin and about 1.6 to 3.5 weight percent of these colloidal clays in the finished paper. In the preferred range of area weights of 55 to 70 g/m$^2$ and at a density of 1.0 to 1.15 g/cc, such a paper has a Bekk smoothness of 900 to 1,200 seconds after calendering.

The excellent printing results, which can be achieved with such a paper, may be attributed, inter alia, to the fact that the paper has a homogeneous surface as already mentioned. It is at the same time a particular advantage that the clays, which envelop the fibers do not require a binder of a different auxiliary for their fixation. These clays also have the advantageous capability to firmly combine with the fibers by means of hydrogen bonding.

The following examples illustrate the present invention.

EXAMPLE 1

A semi-bleached softwood sulfate pulp is dispersed in a pulper at a consistency of 4.8% and a pH of 7 and beaten to a freeness of 23° SR (Schopper Riegler). In a central stock preparation unit, the chemical pulp is mixed with a chip-free mechanical pulp of 76° SR in a ratio of 24:76.

A 42% kaolin slurry is prepared in a separate vessel and adjusted to a pH of 8.4. To this slurry, a 3.5% solution of a sodium/calcium bentonite, with a Na:Ca ion ratio of 40:60 is added. The mixing of the kaolin slurry with the colloidal solution of the bentonite is carried out in such a manner that there are 8.6 parts by weight of kaolin to 1 part by weight of bentonite, the weight proportions referring to the absolutely dry substance.

To 71 parts by weight of the pulp mixture described, 29 parts by weight of the kaolin/bentonite mixture, calculated as solids, are now added. The total furnish is now adjusted with aluminum sulfate to a pH of 5.2 and, after a further dilution, is supplied to a head box of paper machine, from where it is formed into a paper with an area weight of 60 g/m$^2$. After drying, the paper web is treated on a supercalender to produce a density of 1.12. The finished paper has a Bekk smoothness of 1,100 seconds and has the following fiber composition:

75 weight percent of mechanical woodpulp
25 weight percent of chemical woodpulp

Based on the total furnish, the finished paper contains 22 weight percent of kaolin and
2.5 weight percent of film-forming clays.

EXAMPLE 2

A pulp from a semi-bleached softwood sulfate pulp having a pH of 7.2 and a freeness of 20° to 22° SR, is added at a consistency of 3.5 weight percent to a 7 weight percent colloidal solution of a well swollen sodium attapulgite. If both are calculated on the basis of their solids content, there are 100 parts by weight of pulp to 8.3 parts of weight of attapulgite.

The mixture of attapulgite solution and pulp fiber is mixed in a known manner with mechanical woodpulp so that there are (without attapulgite) 76 parts by weight of mechanical woodpulp to 24 parts by weight of chemical woodpulp.

A 40% by weight kaolin slurry, adjusted to a pH of 8.3, is added to the mixture of mechanical woodpulp, chemical woodpulp and attapulgite solution so that there are 100 parts by weight of the mixture of mechanical woodpulp, chemical woodpulp and attapulgite to 19.6 weight percent of kaolin. This mixture is adjusted with alum to a pH of 4.6 and, after dilution in the usual manner, formed into a paper web. The dried and calendered paper has an area weight of 62 g/m$^2$ and a density of 1.1 g/cc, as well as a Bekk smoothness of 1150 seconds. The fibrous material consists of 75.5 parts by weight of mechanical woodpulp and 24.5 parts by weight of chemical woodpulp. There are 1.8 parts by weight of attapulgite and 18 parts by weight of kaolin, calculated on the basis of the total furnish of the paper.

EXAMPLE 3

A paper is prepared as described in Example 2. However, the attapulgite used in Example 2, is replaced by sepiolite. A paper of 67 g/m$^2$ is obtained. It has a density of 1.14 g/cc, a Bekk smoothness of 1000 seconds and a fiber stuff composition of 24 weight percent of chemical woodpulp and 76 weight percent of mechanical woodpulp. Based on the furnish, there are 18.5 parts by weight of kaolin and 1.7 parts by weight of sepiolite in the paper.

EXAMPLE 4

A paper is prepared in accordance with Example 1, with the exception that the sodium/calcium bentonite in Example 1 is replaced with a sodium/magnesium bentonite with an ion ratio of Na:Mg of 75:25.

EXAMPLE 5

A semi-bleached softwood sulfate pulp is dissolved in the pulper at a consistency of 4.8% and a pH of 7 and is beaten to 23° SR. After beating, 1.5% by weight of a mixture of Na/Mg bentonite and polyglycol which had been prepared as follows are added to the pulp:

1.5% by weight NaOH and 7% by weight $MgSO_4$ are added to a previously dispersed 8% calcium bentonite suspension. A high viscosity is obtained which is considered a good sign for activation. From a 6% solution, a polyglycol with a molecular weight of 20,000 is added in an amount of 18% by weight relative to the bentonite.

In a mixing unit, the treated chemical woodpulp is mixed with a chip-free mechanical woodpulp of 76° SR in a ratio of 25:75% by weight and with a separately prepared slurry of kaolin and calcium carbonate. The kaolin/calcium carbonate slurry consists to 70 parts by weight of kaolin and 30 parts by weight of calcium carbonate. The suspension has a ratio of pulp to filler of 71:29.

At a pH value of 7.4, this mixture is diluted to 0.8% and a paper web is formed in the conventional manner. The dried and supercalendered paper has a weight per unit area of 60 g/m$^2$, a density of 1.1 and a smoothness according to Bekk of 1,100 seconds. The ash content is 25%.

COMPARISON EXAMPLE

A paper is prepared as described in Example 1. However, no hydratable, film-forming, colloidal clay is employed. The proportion of kaolin is increased so that the finished paper contains 24.5 parts by weight of kaolin and, in other respects, has the same fiber stuff composition as the paper of Example 1. The finished paper has an area weight of 60 g/m$^2$, a density of 1.13 and a Bekk smoothness of 1120 seconds.

The paper webs described in Examples 1 to 5 and in the Comparison Example are printed with a toluene-containing printing ink on a rotogravure machine. In the case of the paper webs, prepared according to the inventive examples, there is a significantly higher degree of blackening and a better color intensity in the areas printed black. The printed image has a more brilliant even solid and has a better color gloss. In contrast, the paper web prepared according to the Comparison Example and corresponding in other respects to the mechanical values and the composition of the inventive example, but whose fibers have no enveloping of hydratable, film-forming, colloidal clays, has a noticeably inferior and less brilliant even solid.

The better printing results in the case of the paper webs prepared according to Examples 1 to 5, may be explained by the increased toluene holdout, which leads to less migration.

The improved effect relative to toluene-containing printing inks is illustrated once more by carrying out the laboratory experiment, which is described in the following and which is also known under the name of Patra test.

An experimental appratus is used which consists of an inclined plane and a roller, which rolls down the plane. Both are constructed of polished steel. Samples of paper web, prepared according to Examples 1 to 5 and the Comparison Example are attached to the inclined plane. A defined drop of colored toluene is then placed on the roller, which immediately is allowed to roll down the inclined plane. In so doing, the paper samples are mounted on the inclined plane so that the roller, prior to rolling over the paper sample, rolls out the solvent drop on the inclined plane. The ink spot, rolled out on the roller, is then transferred to the paper sample. The size of the colored mark depends on the toluene holdout of the paper. The size of the mark is evaluated and it turns out that the paper webs, prepared according to the inventive examples, produce a significantly larger area than the paper web which had been prepared according to the Comparison Example.

What is claimed is:

1. In a method for rotogravure printing on a paper using a printing ink containing water-immiscible solvents, the improvement which comprises the paper comprising a fibrous paper web, the fibers of which are partially or totally enveloped with a coating of a clay hydrogel which clay is hydratable, is colloidal and is film-forming, said web having an area weight of from about 45 to 100 g/m$^2$, a density of from about 0.95 to 1.2 g/cc and a smoothness of from about 600 to 1500 Bekk seconds and containing conventional inorganic fillers in amounts of more than 15% by weight expressed as the ash content wherein the hydratable, film-forming, colloidal clay contains a montmorillonite mineral selected from the group consisting of minerals in which the ratio of sodium and calcium is between 40:60 and 60:40 and minerals whose ion portion is composed of up to 40% magnesium ions with the remainder of the ion portion being sodium ions.

2. The method of claim 1 wherein the clay is present in an amount of from about 1.2 to 8 weight percent, based on the total weight of the paper.

3. The method of claim 1 or 2 wherein the clay is selected from the group consisting of bentonite, attapulgite, sepiolite, and mixtures thereof.

4. The method of claim 1 or 2 wherein conventional inorganic fillers are present in amounts of more than 15% by weight expressed as the ash content.

5. The method of claim 1 or 2 wherein conventional inorganic fillers are present in amounts of more than 15% by weight expressed as the ash content, selected from the group consisting of kaolin, calium carbonate, talc and titanium dioxide.

6. The method of claim 1 or 2 wherein the chemical woodpulp content, based on the total amount of fibrous material, is greater than 10%.

7. The method of claim 1 or 2 wherein the paper has an area weight of about 55 to 70 g/m$^2$, a density of about 1.0 to 1.15 g/cc, a Bekk smoothness of 900 to 1,200 seconds and the following composition:

75 to 80 weight percent of mechanical woodpulp,
20 to 25 weight percent of chemical woodpulp,
18 to 26 weight percent of kaolin, and
1.6 to 3.5 weight percent of hydratable, colloidal, film-forming clays, based on the total weight of material.

8. The method of claim 1 or 2 wherein macromolecules of polyglycols with a molecular weight of 5,000 to 100,000 are connected to the hydratable, film-forming, colloidal clays.

* * * * *